United States Patent [19]

Jaffe et al.

[11] 3,961,298

[45] June 1, 1976

[54] DUAL PLUNGER SOLENOID

[75] Inventors: Wolfgang Jaffe, Roselle Park; Oswald M. Porter, Livingston, both of N.J.

[73] Assignee: The Singer Company, New York, N.Y.

[22] Filed: May 7, 1975

[21] Appl. No.: 575,282

[52] U.S. Cl. ..... 335/259; 335/265

[51] Int. Cl.[2] ..... H01F 7/18

[58] Field of Search ..... 335/259, 257, 255, 265, 335/267, 249, 279, 271; 310/14, 30

[56] References Cited

UNITED STATES PATENTS

| | | | |
|---|---|---|---|
| 1,817,592 | 8/1931 | Sokoloff | 335/259 |
| 3,473,780 | 10/1969 | Harms | 335/259 |
| 3,805,099 | 4/1974 | Kelly | 335/259 |

*Primary Examiner*—Harold Broome

*Attorney, Agent, or Firm*—Marshall J. Breen; Robert E. Smith; Edward J. Bell

[57] ABSTRACT

A solenoid is provided in which the armature unit includes a primary plunger and a secondary plunger arranged in telescopic association one with the other and disposed so that the secondary plunger, having both a smaller mass and a smaller air gap than the primary plunger, initially draws in the primary plunger against the anvil without altering the stroke of the primary plunger. The coaction between the two plungers materially reduces the electric energy required to operate the solenoid. While not limited in its application to any particular form of magnetic circuit or to any particular size of magnet, the invention is especially useful in connection with mechanism in which a miniature solenoid is required, and also when it is required to employ a solenoid in which the armature stroke is relatively large and the power requirement must be small.

4 Claims, 2 Drawing Figures

DUAL PLUNGER SOLENOID

BACKGROUND OF THE INVENTION

It is well known in the art to construct solenoids in which the armature assembly is made of a primary plunger and one or more secondary plungers that are serially arranged along the path which the magnetic flux will take when the solenoid is energized. More specifically, it is well known to provide an electromagnet of the type last stated in which the plurality of series air gaps in the magnetic circuit are progressively closed when the solenoid is energized, all armatures of the series being mechanically interconnected which compel the main armature to move towards the zone of maximum tractive effort as the armature situated in such zone moves towards the core or anvil, or towards a supplemental armature which has been attracted to the anvil. The U.S. Pat. No. 1,817,592 is directed to such a solenoid.

SUMMARY OF THE INVENTION

It is the primary object of the present invention to provide a solenoid having an armature assembly including a primary plunger and at least one secondary plunger telescopically interconnected with said primary plunger for limited axially movement relative to the primary plunger and having its end portion manually projecting beyond the end portion of the primary plunger for movement in the same air gap as that traversed by the primary plunger upon energization of the solenoid.

With the above and additional objects and advantages in view as will hereinafter appear, this invention will be described with reference to the accompanying drawing of a preferred embodiment.

DESCRIPTION OF THE PREFERRED EMBODIMENT

Figure 1:
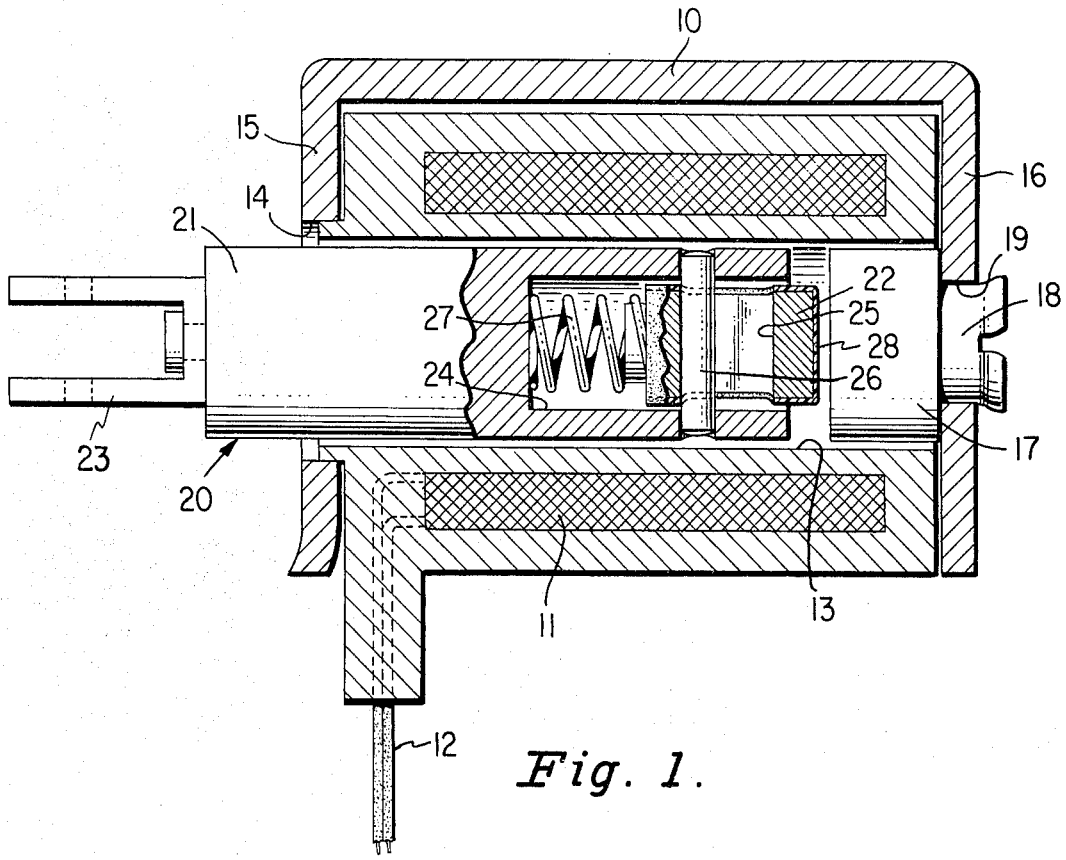
FIG. 1 is a longitudinal cross-sectional view of a solenoid incorporating the principles of the present invention, showing the relationship of the armature assembly components when the solenoid is deenergized.

Referring to the drawing the invention is disclosed as embodied in a solenoid having a frame 10 having a coil 11 connected by wires 12 to a source of electrical energy (not shown). The coil 11 is provided with a cylindrical through-bore 13 one end of which opens into an aperture 14 formed in one end wall 15 of the frame 10 and the other end is closed by the other end wall 16 of the frame 10.

Disposed within the coil bore 13 at the end closed by the frame end wall 16 is an anvil 17 made of magnetic material and formed with a neck 18 projecting through a hole 19 in the end wall 16, which neck is flared to secure the anvil tightly in place.

Entering the open end of the coil bore 13 is an armature assembly indicated as 20. The armature assembly, in its preferred form, includes a primary plunger 21 and a secondary plunger 22. Both of the plungers are made of magnetic material. As shown in FIG. 1 the primary plunger 21 has fastened to its exposed or outer end a fork-shaped connector element 23 adapted to be secured to a suitable mechanism (not shown) designed to be influenced by the operation of the solenoid. It is obvious that the connector element can be of any shape and such shape would depend upon the type of mechanism to which the solenoid is connected.

The inner end of the primary plunger 21 is formed with a cylindrical recess 24 in which is disposed the secondary plunger 22. The secondary plunger is formed with an elongated slot 25 through which extends a stop-pin 26 secured at its ends in the primary plunger 21. Disposed within the recess 24 of the primary plunger 21 is a coil spring 27 which is in slight compression and acts between the two plungers to bias them apart, and when the solenoid is deenergized the coil spring urges the secondary plunger 22 against the stop-pin 26. In order not to affect the flux path the stop-pin 26 and the coil spring 27 are made of nonmagnetic material. It has been found in practice that a stainless steel stop-pin and a beryllium copper spring functions very well.

It will be noted in the drawing that the secondary plunger 22 has a thin covering of plastic 28 encasing its sides and its end wall adjacent the anvil 17. Mylar has been found to provide a very satisfactory covering. The advantages gained from the use of the plastic covering is the reduction of noise during movement of one plunger relative to the other plunger. Also, the effect of the residual flux is minimized thus permitting easy break away of the armature assembly from the anvil 17 when the solenoid is deenergized.

Referring now to FIG. 1, it will be understood that the parts are illustrated in the position they assume when the solenoid is deenergized, and the position of the primary plunger 21 is normally determined by the mechanism to which it is connected. It will be seen that the coil spring 27 biases the secondary plunger 22 outwardly against the stop-pin 26 thereby defining a small air gap between the secondary plunger and the anvil 17. With the existence of this small air gap the secondary plunger moves toward the anvil when a relatively small electric current is applied to the coil 11. Through the interconnection of the secondary plunger with the primary plunger, by way of the slot 25 and the stop-pin 26, movement of the secondary plunger pulls the primary plunger in the direction of the anvil, with the result that the primary plunger traverses its larger air gap requiring less electrical energy than what would be required if the secondary plunger were eliminated.

Figure 2:
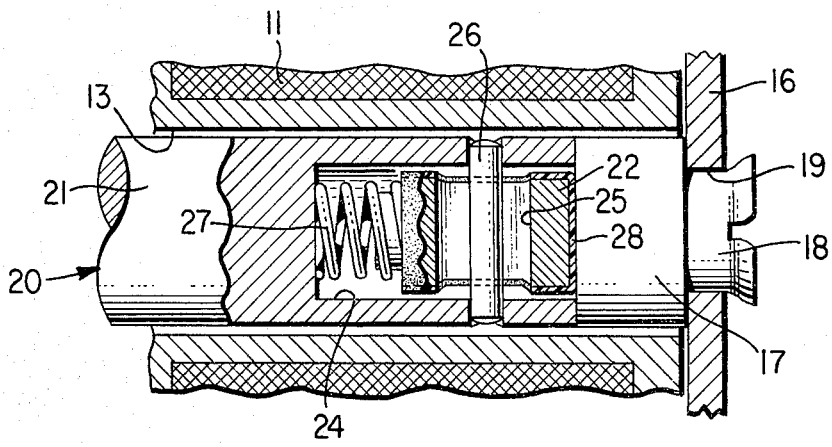
FIG. 2 is a fragmentary cross-sectional view illustrating the relationship of the armature assembly components when the solenoid is energized.

As shown in FIG. 2, when the solenoid is energized the primary plunger 21 moves into engagement with the anvil 17 and the coil spring 27 is compressed to allow the secondary plunger 22 to remain in contact with the anvil.

It will be understood that the space between the anvil 17 and the inner end of the primary plunger 21 comprises a single air gap, and that the secondary plunger 22 moves through the same air gap. Thus, it will be understood that both plungers move through the same air gap.

It is understood that the present disclosure relates to a preferred embodiment of our invention which is for the purposes of illustration only and not to be construed as a limitation of the invention. All such modifications which do not depart from the spirit of the invention are intended to be included within the scope of the appended claims.

Having thus described the nature of the invention, what we claim herein is:

1. A solenoid having a current carrying coil and an armature assembly located within and movably longitudinally of said coil, said armature assembly including a primary plunger and at least one secondary plunger telescopically arranged and mechanically interconnected with said primary plunger for limited axially movement relative to the primary plunger and having its end portion normally projecting beyond the end portion of said primary plunger for movement in the same air gap as that traversed by the primary plunger upon energization of the solenoid, said mechanical interconnection between said primary and secondary plungers being such that the initial movement of said second plunger exerts an immediate pulling force on said primary plunger.

2. A solenoid as set forth in claim 1 wherein the interconnection between the primary and secondary plungers includes a stop-pin secured to one of said plungers and extending through a slot in the other of said plungers.

3. A solenoid as set forth in claim 2 wherein the primary plunger is formed with a recess in one end and the secondary plunger is slidable in said recess.

4. A solenoid as set forth in claim 3 wherein the secondary plunger is biased outwardly of the primary plunger by a spring mounted in the recess in compressed condition to bias the stop-pin into contact with the end of the slot.

* * * * *